US009184516B2

(12) United States Patent
Nobukuni

(10) Patent No.: US 9,184,516 B2
(45) Date of Patent: Nov. 10, 2015

(54) CONNECTION STRUCTURE FOR GROUND TERMINAL FITTING

(71) Applicant: Sumitomo Wiring Systems, Ltd., Yokkaichi (JP)

(72) Inventor: Takashi Nobukuni, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/503,576

(22) Filed: Oct. 1, 2014

(65) Prior Publication Data

US 2015/0099389 A1 Apr. 9, 2015

(30) Foreign Application Priority Data

Oct. 7, 2013 (JP) ..... 2013-210480

(51) Int. Cl.
*H01R 4/30* (2006.01)
*H01R 4/64* (2006.01)
*H01R 11/12* (2006.01)

(52) U.S. Cl.
CPC ..... *H01R 4/305* (2013.01); *H01R 4/64* (2013.01); *H01R 11/12* (2013.01); *H01R 2201/26* (2013.01)

(58) Field of Classification Search
CPC ..... H01R 4/305
See application file for complete search history.

(56) References Cited

U.S. PATENT DOCUMENTS

| | | | | | |
|---|---|---|---|---|---|
| 2,000,665 | A * | 5/1935 | Neal | 439/440 |
| 2,555,074 | A * | 5/1951 | Bergan | 439/777 |
| 3,796,124 | A * | 3/1974 | Crosa | 411/521 |
| 4,002,390 | A * | 1/1977 | Perry et al. | 439/433 |
| 5,188,544 | A * | 2/1993 | Mukai | 439/777 |
| 6,086,399 | A | 7/2000 | Matsunaga et al. | |
| 6,250,973 | B1 * | 6/2001 | Lowery et al. | 439/763 |
| 7,160,157 | B1 * | 1/2007 | Jones et al. | 439/883 |
| 7,458,861 | B1 * | 12/2008 | Eke et al. | 439/798 |
| 7,867,044 | B2 * | 1/2011 | Lee | 439/883 |
| 2015/0099388 | A1 * | 4/2015 | Nobukuni | 439/359 |
| 2015/0099389 | A1 * | 4/2015 | Nobukuni | 439/359 |

FOREIGN PATENT DOCUMENTS

JP 2004-253167 9/2004

* cited by examiner

*Primary Examiner* — James Harvey
(74) *Attorney, Agent, or Firm* — Gerald E. Hespos; Michael J. Porco; Matthew T. Hespos

(57) ABSTRACT

A grounding member (20) is formed with a receiving hole (23), and a ground terminal fitting (10) is formed with a cantilevered lock (13) including a step (13B). The lock (13) is locked to the receiving hole (23) with the step (13B) contact with a stopper (24) of the receiving hole (23). In tightening a first bolt (51) at a first mounting hole (151) and a first female screw hole (51), a rotational force in a direction to bring the step (13B) into contact with the stopper (24) is applied to a terminal main body (11). Butting portions (14) protrude from side edges (13D) of the lock (13) and prevent following rotation of the terminal main body (11) by contacting receiving surfaces (25) when the first bolt (51) is tightened.

5 Claims, 7 Drawing Sheets

CONNECTION STRUCTURE FOR GROUND TERMINAL FITTING

BACKGROUND

1. Field of the Invention

The invention relates to a connection structure for ground terminal fitting.

2. Description of the Related Art

Japanese Unexamined Patent Publication No. 2004-253167 discloses a connection structure for fitting and connecting through holes of a ground terminal to two stud bolts projecting on a ground panel. The connection structure that has stud bolts projecting on the ground panel easily positions the ground terminal with respect to the ground panel. However, positioning the ground terminal with respect to the ground panel is difficult with a connection structure that has a female screw hole provided on a ground panel and a through hole of a ground terminal positioned with respect to the female screw hole.

Considered has been given to penetrating a receiving portion through the ground panel, projecting a lock on the outer peripheral edge of the ground terminal and then positioning the ground terminal by inserting the lock into the receiving portion and bringing a step into contact with the opening edge of the receiving portion. However, the step may deviate from the opening edge of the receiving portion and the lock may be inserted deep into the receiving portion when screwing a bolt inserted through one of the two through holes into the female screw hole. Thus, the ground terminal is displaced with respect to the grounding member and the other through hole deviates from the female screw hole and cannot be bolt-fastened.

The invention was completed based on the above situation and aims to prevent a displacement when a bolt is first tightened in the case of successively tightening bolts at two positions.

SUMMARY OF THE INVENTION

The invention relates to a connection structure for ground terminal fitting and includes a grounding member with a ground contact surface. First and second female screw holes and a hole-shaped receiving portion are formed on the grounding member. A plate-like terminal main body is formed on the ground terminal fitting and can come into surface contact with the ground contact surface. A lock is cantilevered from the outer peripheral edge of the terminal main body and is formed with a step. The lock can be locked with the step contacting the opening edge of the receiving portion by inserting a projecting end of the lock into the receiving portion. A first mounting hole is formed on the terminal main body and registers with the first female screw hole by locking the lock to the receiving portion. Hole is formed on the terminal main body and registers with the second female screw hole by locking the lock to the receiving portion. The ground terminal fitting is mounted in surface contact with the grounding member by inserting a first bolt through the first mounting hole, screwing the first bolt into the first female screw hole, inserting a second bolt through the second mounting hole and screwing the second bolt into the second female screw hole. A rotational force in a direction to bring the step into contact with the opening edge of the receiving portion is applied to the terminal main body when the first bolt is tightened. A butting portion protrudes from a side edge of the lock extending along a projecting direction and is configured to prevent following rotation of the terminal main body portion by contacting an area of the ground contact surface near an opening area of the receiving portion when the first bolt is tightened.

The step of the lock may deviate from the opening edge of the receiving portion when the first bolt is tightened. However, the butting portion of the terminal main body contacts the area of the ground contact surface near the opening area of the receiving portion to prevent the following rotation of the terminal main body, thereby preventing a displacement of the second mounting hole with respect to the second female screw hole.

Two butting portions may be provided at opposite sides of the lock. The two butting portions stably contact the area of the ground contact surface near the opening area of the receiving portion for reliably preventing the following rotation of the terminal main body.

A difference between inner diameters of the second female screw hole and the second mounting hole may exceed a difference between inner diameters of the first female screw hole and the first mounting hole. Accordingly, if the bolt is first tightened to fix the ground terminal fitting to the grounding member at the first female screw hole and the first mounting hole having a smaller inner diameter difference, there is no likelihood that an opening area of the second mounting hole deviates from that of the second female screw hole at the second female screw hole and the second mounting hole having a larger inner diameter difference.

A distance from the receiving portion to the first female screw hole may exceed a distance from the receiving portion to the second female screw hole. The technical significance of this configuration is as follows. In the case of, a moment acting on the receiving portion and the locking portion when tightening the bolt is suppressed lower as a distance from a center of rotation of the bolt to the receiving portion becomes longer. Thus, the distance from the first female screw hole to be first bolt-fastened to the receiving portion is longer than the distance from the second female screw hole to be bolt-fastened later. In this way, loads on the receiving portion and the lock can be reduced.

The ground terminal fitting may include a wire connecting portion to which a wire is to be connected. The lock may be arranged on an axis line extension line of the wire connected to the wire connecting portion, and an inserting direction of the lock into the receiving portion may be substantially parallel to an axial direction of the wire. Accordingly, an operation of inserting the lock into the receiving portion is performed easily.

DETAILED DESCRIPTION

A connection structure for a ground terminal fitting is identified by the numeral 10 in FIGS. 1 to 7 and is configured for fixing and electrically conductively connecting the ground terminal fitting 10 in surface contact with a ground contact surface 21 of a grounding member 20 such as a body of a vehicle. Note that, an upper side in FIGS. 1, 3 to 6 is defined as a "front" concerning a front-back direction. Further, a vertical direction is based on FIGS. 2 and 7 and a lateral direction is based on FIGS. 1, 3 to 6.

Figure 1:
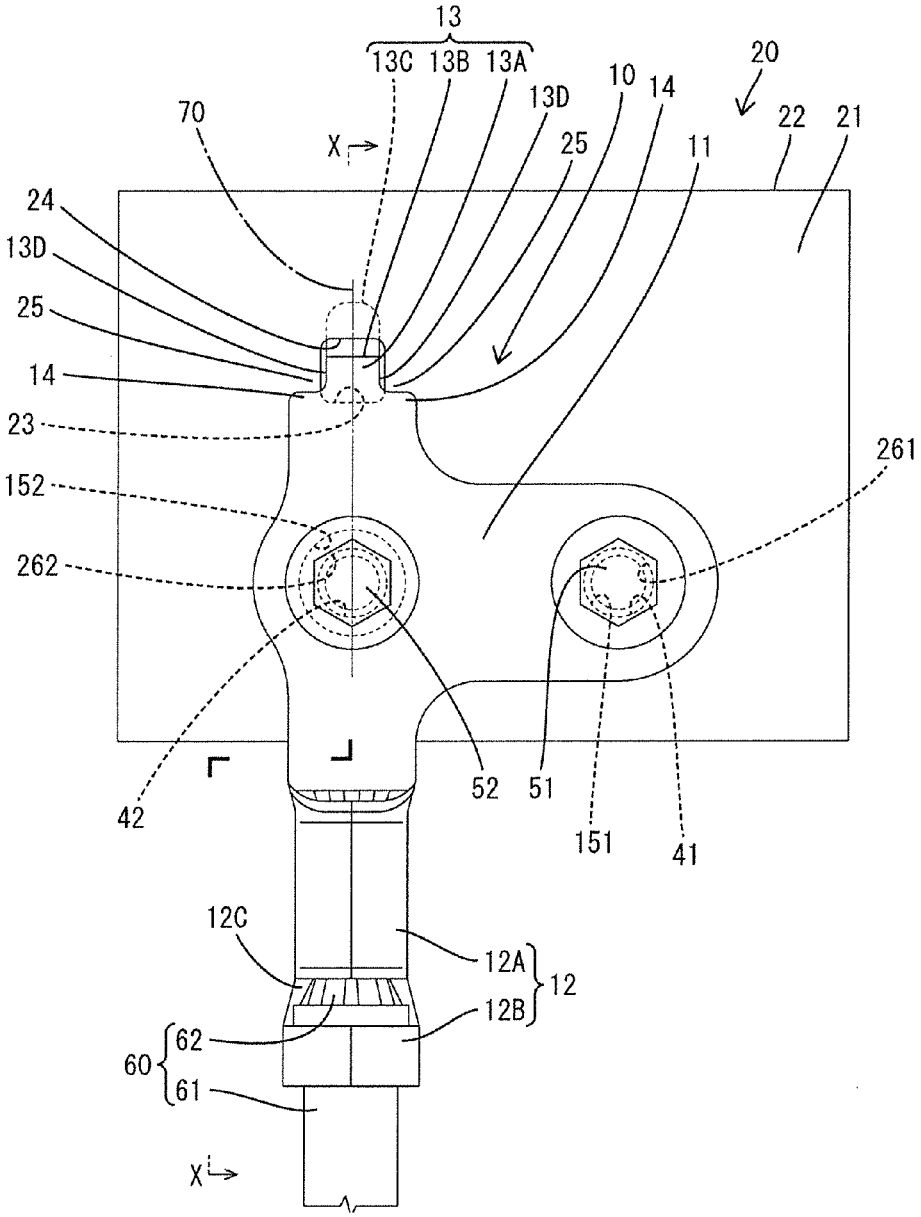
FIG. 1 is a plan view showing a state where a ground terminal fitting is connected to a grounding member in one embodiment.
Figure 2:
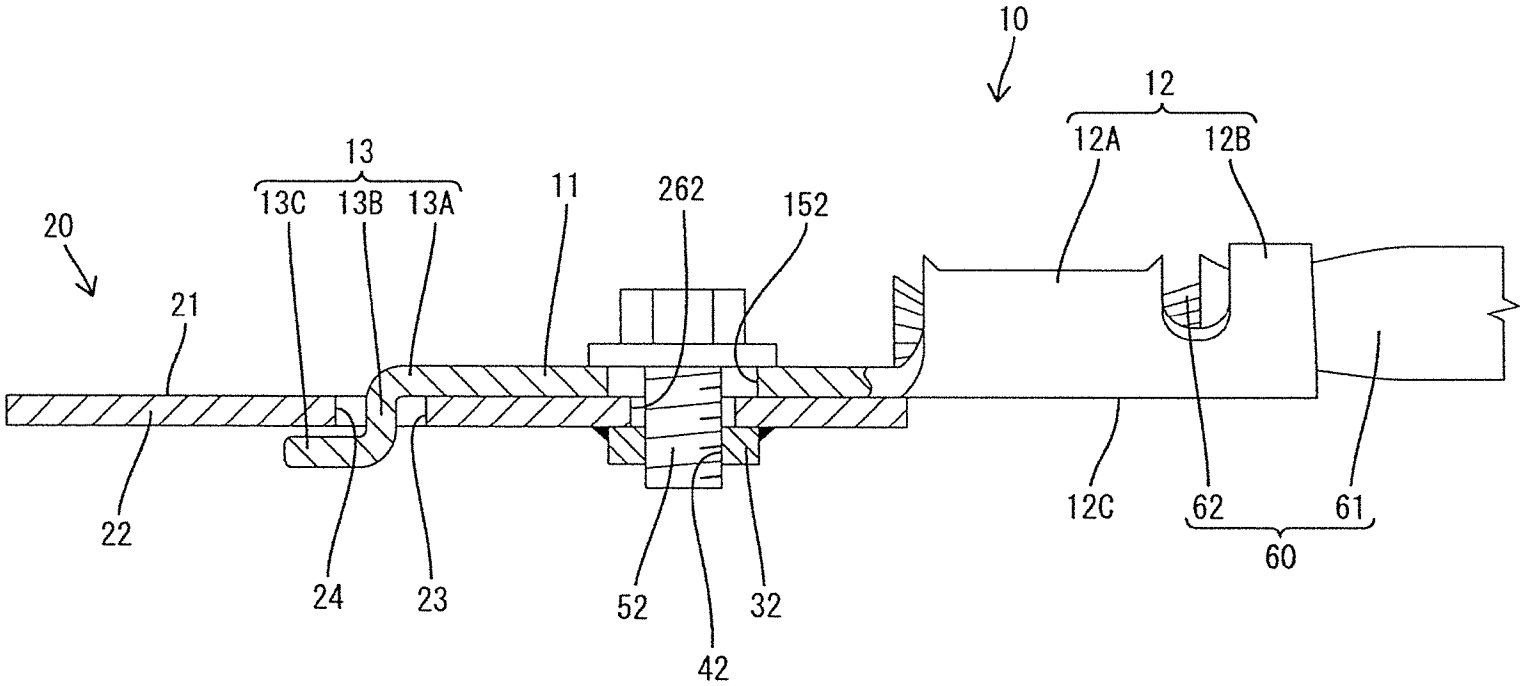
FIG. 2 is a section along X-X of FIG. 1.
Figure 3:
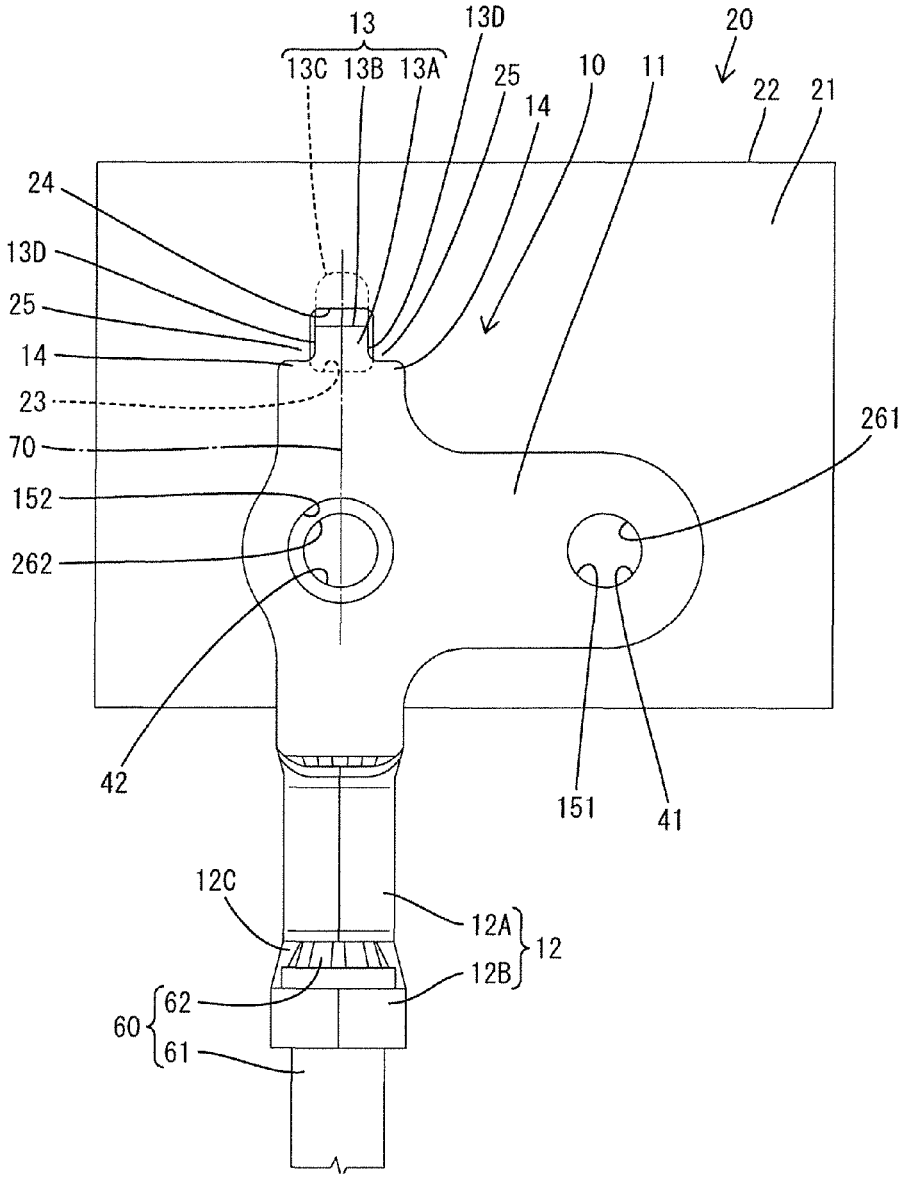
FIG. 3 is a plan view showing a state where the ground terminal fitting is positioned with respect to the grounding member by locking a locking portion to a receiving portion.
Figure 4:
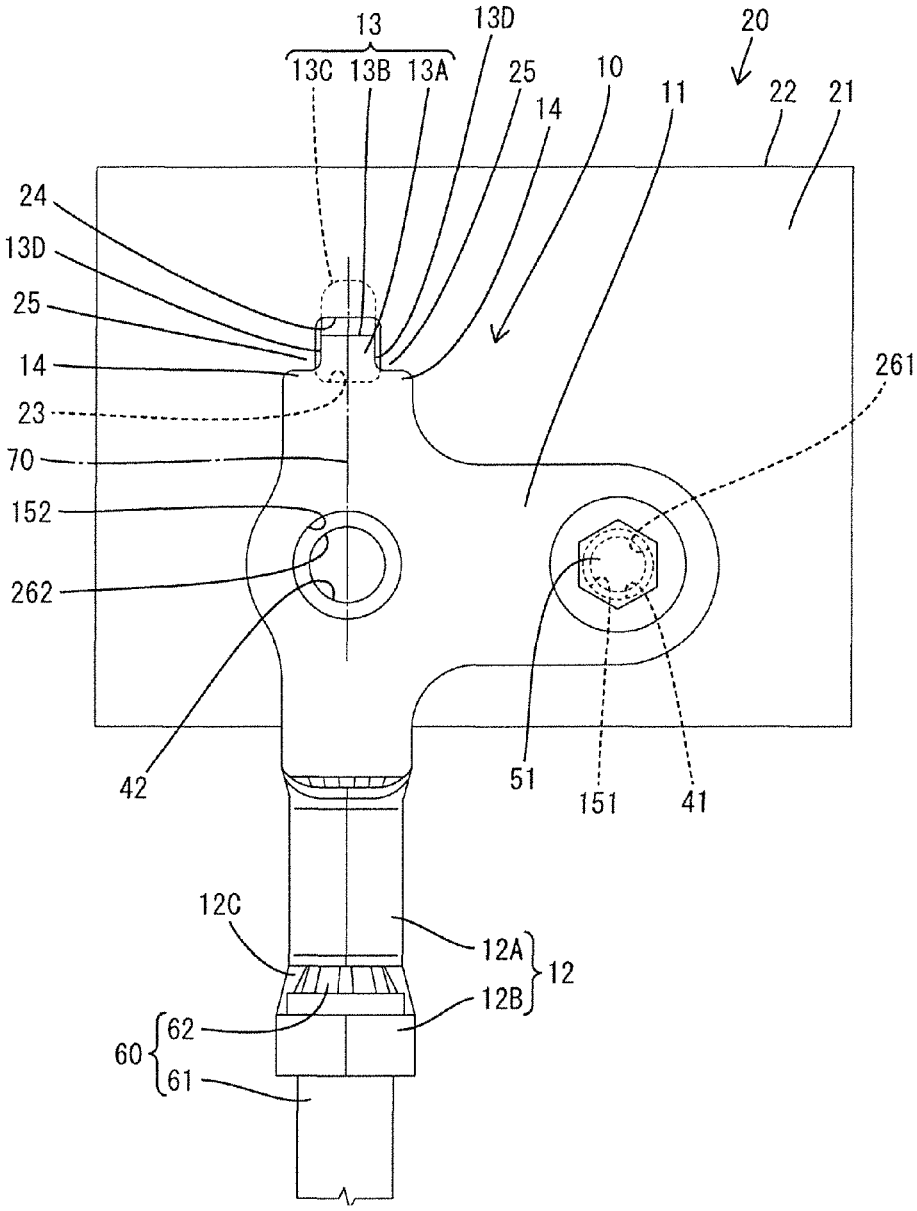
FIG. 4 is a plan view showing a state where a bolt is tightened at a first female screw hole and a first mounting hole from the state of FIG. 3.
Figure 5:
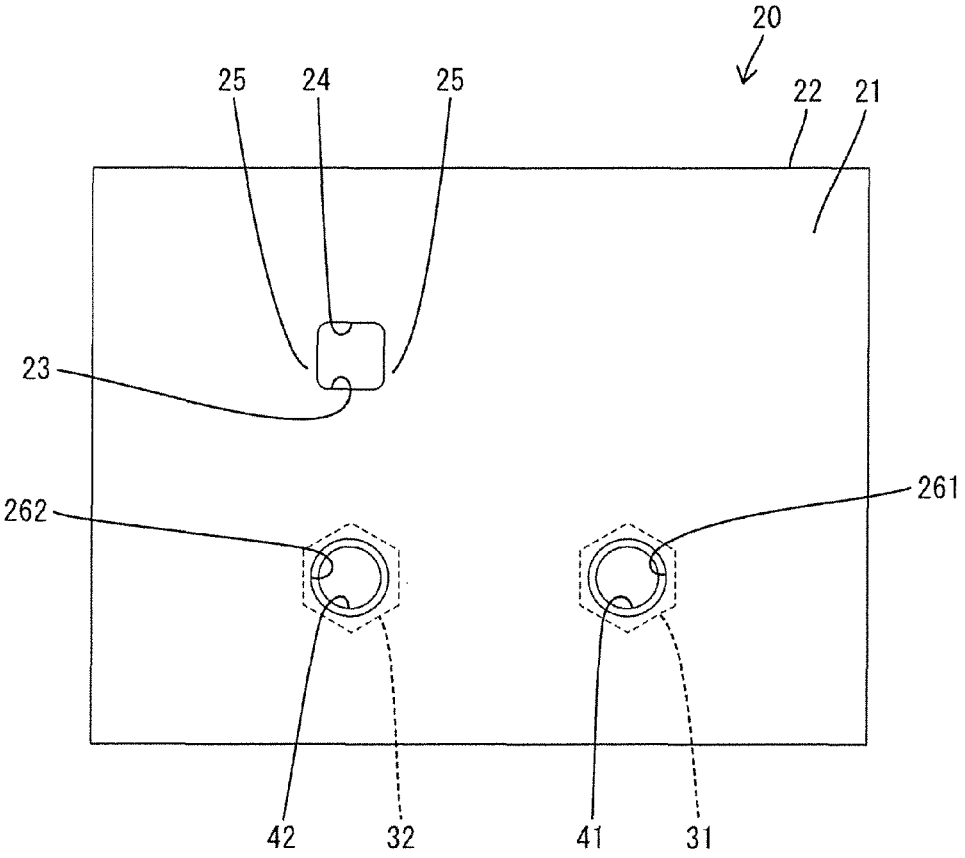
FIG. 5 is a plan view of the grounding member.

As shown in FIGS. 2 and 5, the grounding member 20 includes a panel 22 in the form of a flat metal plate. A first metal nut 31 is fixed electrically conductively to the lower surface of the panel 22, such as by welding and a second metal nut 32 is fixed electrically conductively to the lower surface of the panel 22, such as by welding. The upper surface of the panel 22 defines the ground contact surface 21 for electrically conductive connection to the ground terminal fitting 10.

A receiving portion 23 penetrates through the panel 22 from the upper to lower surfaces of the panel 22 and has a substantially rectangular opening in a plan view thereof. A front edge of the opening edge of the receiving portion 23 defines a stopper 24. Areas of the ground contact surface 21 of the panel 22 near opposite left and right opening edges of the receiving portion 23 function as receiving surfaces 25. The receiving portion 23 has both a positioning function of determining the position of the ground terminal fitting 10 on the upper surface of the panel 22 in a horizontal direction and a rotation stopping function of preventing following rotation of the ground terminal fitting 10 when bolts 51, 52 are tightened.

The second nut 32 is arranged at a position behind and at a distance from the receiving portion 23. That is, a straight line connecting the second nut 32 and the receiving portion 23 extends in the front-back direction. The first nut 31 is arranged behind the receiving portion 23 and to the right of the second nut 32. A straight line connecting the first and second nuts 31, 32 extends in the lateral direction and is perpendicular to the straight line that connects the second nut 32 and the receiving portion 23. Thus, the receiving portion 23, the first nut 31 and the second nut 32 constitute vertices of a right-angled triangle.

The first nut 31 is formed with a first female screw hole 41, and the panel 22 is formed with a circular first through hole 261 arranged coaxially with the first female screw hole 41. The first through hole 261 has a slightly larger inner diameter than the first female screw hole 41. The second nut 32 is formed with a second female screw hole 42 having an inner diameter equal to that of the first female screw hole 41. The panel 22 also is formed with a circular second through hole 262 arranged coaxially with the second female screw hole 42. The second through hole 262 has a slightly larger inner diameter than the second female screw hole 42.

Figure 6:
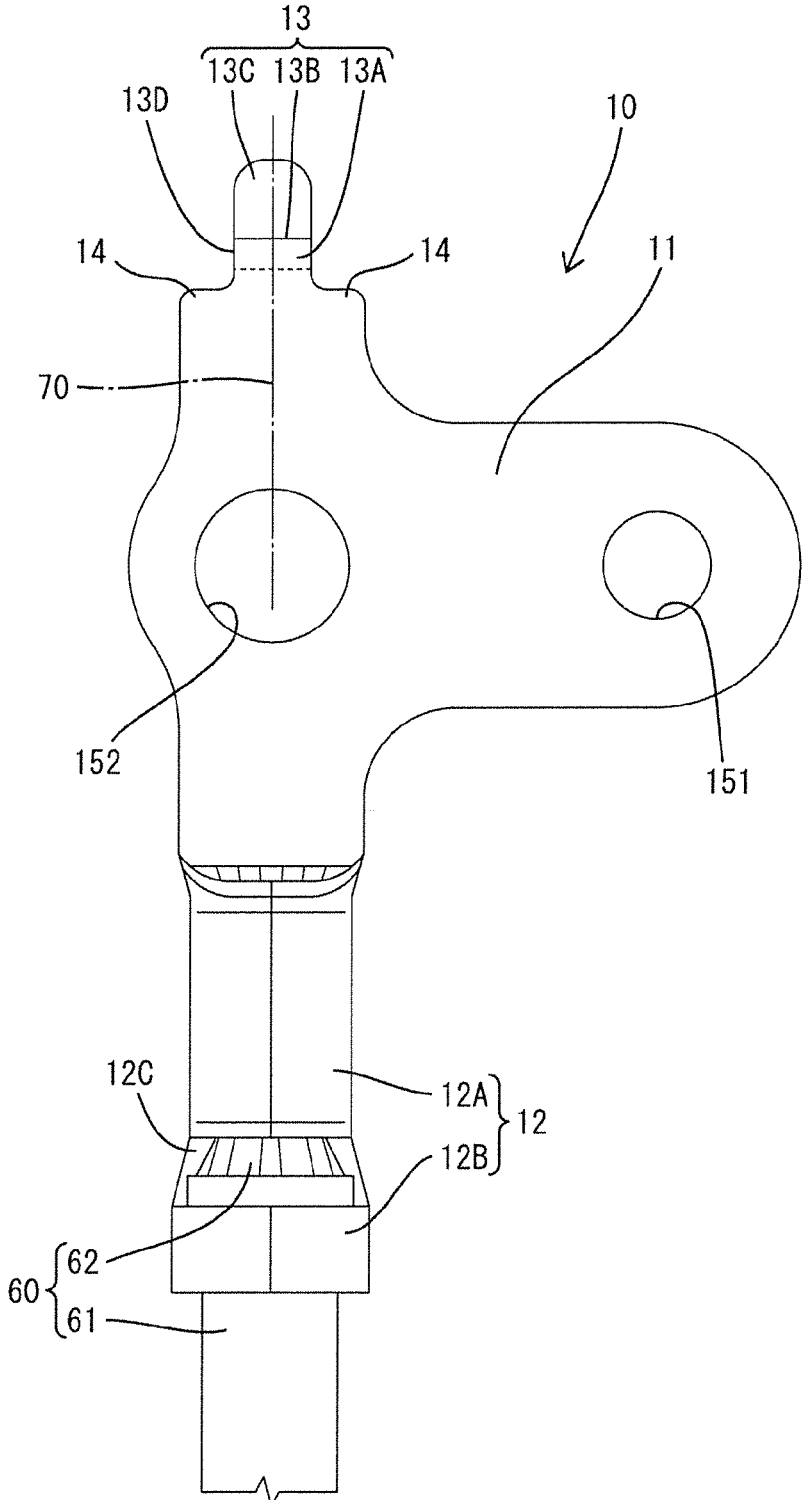
FIG. 6 is a plan view of the ground terminal fitting.
Figure 7:
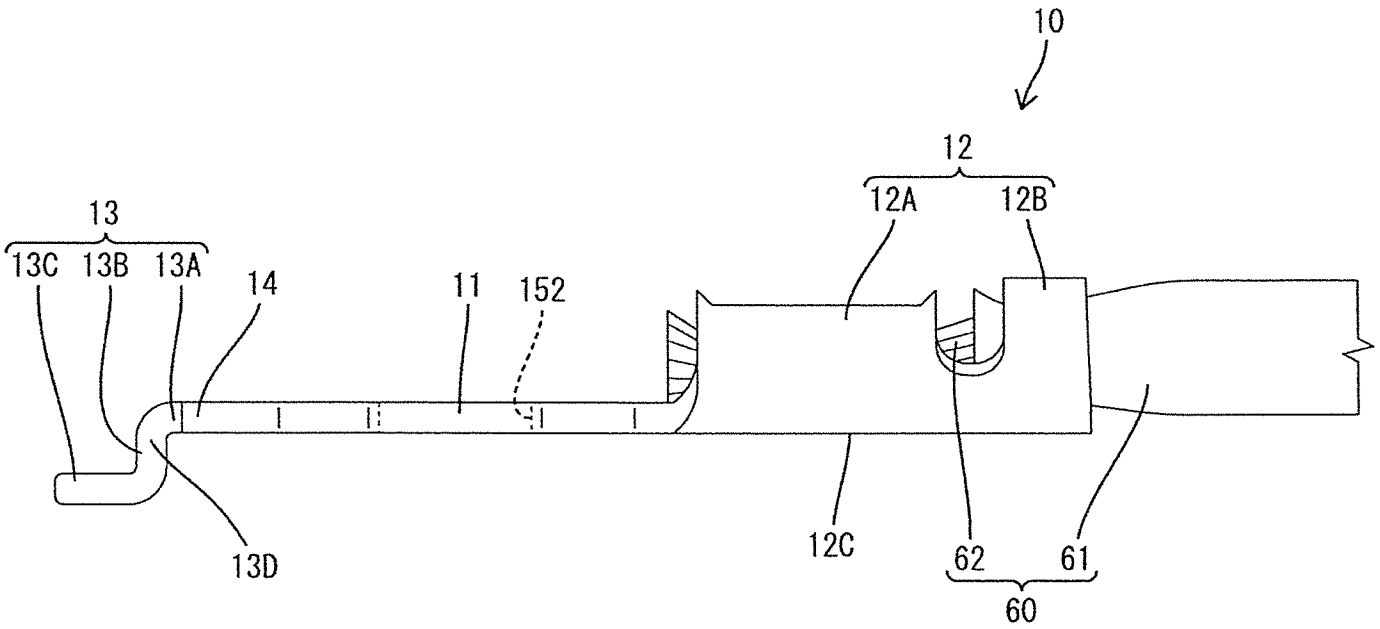
FIG. 7 is a side view of the ground terminal fitting.

The ground terminal fitting 10 is formed by bending a metal plate material punched out into a predetermined shape. As shown in FIGS. 6 and 7, the ground terminal fitting 10 is configured by integrally forming a terminal main body 11 in the form of a flat plate and a wire connecting portion 12 in the form of an open barrel.

The terminal main body 11 has a plan shape obtained by rotating a T shape counterclockwise by 90°. A lock 13 is cantilevered forward from the front end of the terminal main body 11. A width of the lock 13 in the lateral direction is constant over the entire length and is slightly smaller than a width of an opening area of the receiving portion 23. The lock 13 is bent in a stepped manner. Specifically, the lock 13 has a base 13A flush with the terminal main body 11, a step 13B extending down from the projecting end of the base 13A and a tip 13C extending forward from the lower end of the step 13B. The lock 13 is locked by obliquely inserting the tip 13C and the step 13B into the receiving portion 23 from an upper-rear side.

The width of the lock 13 is smaller than the width of an upper end part of the terminal main body 11 and two butting portions 14 are formed at opposite left and right sides of the lock 13 due to this dimensional difference. The butting portions 14 protrude bilaterally symmetrically out in a width direction from left and right edges 13D of the lock 13 and are continuous and flush with the front end part of the terminal main body 11. Further, the front end edges of the butting portions 14 are located on the same straight line to be juxtaposed in the lateral direction. In a state where the lock 13 is locked to the receiving portion 23, the front end edges of the butting portions 14 are laid on the left and right receiving surfaces 25.

A circular first mounting hole 151 penetrates through the terminal main body 11 and registers with the first female screw hole 41 when the lock 13 is locked to the receiving portion 23. An inner diameter of the first mounting hole 151 is slightly larger than inner diameters of the first through hole 261 and the first female screw hole 41. The first bolt 51 can be inserted through the first mounting hole 151 and the first through hole 261 from above the ground terminal fitting 10 and screwed into the first female screw hole 41 when the first mounting hole 151 registers with the first female screw hole 41.

Similarly, a circular second mounting hole 152 penetrates through the terminal main body 11 at a position corresponding to the second female screw hole 42 when the lock 13 is locked to the receiving portion 23. An inner diameter of the second mounting hole 152 is larger than inner diameters of the second through hole 262 and the second female screw hole 42. Thus, the second bolt 52 can be inserted through the second mounting hole 152 and the second through hole 262 from above the ground terminal fitting 10 and screwed into the second female screw hole 42 when the second mounting hole 152 registers with the second female screw hole 42. The second bolt 52 has the same size and shape as the first bolt 51.

The lock 13 is locked to the receiving portion 23 as a first step for mounting the ground terminal fitting 10 on the grounding member 20. Subsequently, the first bolt 51 is screwed and tightened into the first female screw hole 41 and the first mounting hole 151 and, then, the second bolt 52 is screwed and tightened into the second female screw hole 42 and the second mounting hole 152. The inner diameter of the first mounting hole 151 is smaller than the opening area of the second mounting hole 152. Thus, a difference between the inner diameters of the first female screw hole 41 and the first mounting hole 151 to be first bolt-fastened is smaller than a difference between the inner diameters of the second female screw hole 42 and the second mounting hole 152 to be bolt-fastened later.

The lock 13, the first mounting hole 151 and the second mounting hole 152 of the ground terminal fitting 10 are arranged to correspond to the receiving portion 23, the first female screw hole 41 and the second female screw hole 42 of the grounding member 20. Accordingly, the first mounting hole 151, the second mounting hole 152 and the lock 13 are arranged to constitute vertices of a right-angled triangle. A distance from the first mounting hole 151 to be first bolt-fastened to the lock 13 (i.e. distance from the first female screw hole 41 to the receiving portion 23) exceeds a distance from the second mounting hole 152 to be bolt-fastened later to the lock 13 (i.e. distance from the second female screw hole 42 to the receiving portion 23).

The wire connecting portion 12 has a wire barrel 12A and an insulation barrel 12B located behind the wire barrel 12A. The wire barrel 12A and the insulation barrel 12B are of known form. A conductor 62 exposed by removing an insulation coating 61 of an end part of a wire 60 is fixed electrically conductively to the wire barrel 12A. A front end part of the wire 60 where the insulation coating 61 is not removed is fixed to the insulation barrel 12B.

The wire connecting portion 12 has a long narrow base plate 12C. The front end of the base plate 12C is continuous and substantially flush with a rear part of the terminal main body 11. An axis line of the wire 60 fixed to the wire connecting portion 12 extends in the front-back direction. The locking portion 13 is arranged before the wire connecting portion 12 and on an axis line extension line 70 of the wire 60. Similarly, the second mounting hole 152 is arranged between the wire connecting portion 12 and locking portion 13 on the axis line extension line 70 of the wire 60. On the other hand, the first mounting hole 151 is at a position deviated rightward from the axis line extension line 70 of the wire 60. Further, an inserting direction (locking direction) of the locking portion 13 into the receiving portion 23 is substantially parallel to an axis line extension line 70) of the wire 60.

In mounting the ground terminal fitting 10 on the grounding member 20, the terminal main body 11 first is positioned with respect to the ground contact surface 21. At this time, an operator grips a part of the wire 60 near the wire connecting portion 12 with the left hand and controls the position of the lock 13 with respect to the receiving portion 23 while visually confirming the positions of the lock 13 and the receiving portion 23. The locking portion 13 then is inserted into the receiving portion 23 from behind and the step 13B is caused to face the stopper 24. The lateral position of the terminal main body 11 then is adjusted with the receiving portion 23 and the lock 13 as a support so that the first mounting hole 151 and the first female screw hole 41 are aligned coaxially. In this way, the second mounting hole 152 is aligned with the second female screw hole 42 and the terminal main body 11 is positioned with respect to the ground contact surface 21.

The operator then inserts and lightly screws the first bolt 51 into the first mounting hole 151 with the right hand and tightens the first bolt 51 by operating a tool (not shown) with the right hand while gripping the wire 60 with the left hand. At this time, a clockwise rotational force about the first bolt 51 is applied to the terminal main body portion 11. However, the step 13B of the lock 13 is in contact with the stopper 24 of the receiving portion 23 in a clockwise direction. Thus, a following rotation of the terminal main body portion 11 is prevented. In this way, the second mounting hole 152 is held aligned with the second female screw hole 42.

The second bolt 52 then is inserted through the second mounting hole 152, screwed into the second female screw hole 42 and tightened using the tool. At this point, the terminal main body 11 is fixed to the ground contact surface 21 by the first bolt 51 and following rotation of the terminal main body portion 11 is prevented by the first bolt 51 engaged in the first female screw hole 41 and the side edges 13D of the lock 13 caught by the opening edge of the receiving portion 23. An operation of connecting the ground terminal fitting 10 to the grounding member 20 is completed after tightening the second bolt 52.

The connection structure for the ground terminal fitting 10 of this embodiment connects the plate-like terminal main body 11 provided on the ground terminal fitting 10 in surface contact with the grounding member 20. The ground terminal fitting 10 is formed with the wire connecting portion 12 and the lock 13. The lock 13 is arranged on the axis line extension line 70 of the wire 60 connected to the wire connecting portion 12, and is locked to the receiving portion 23 of the grounding member 20. When the lock 13 is locked to the receiving portion 23, the first and second mounting holes 151, 152 formed on the terminal main body 11 of the ground terminal fitting 10 are aligned respectively with the first and second female screw holes 41, 42 of the grounding member 20.

The lock 13 is arranged on the axis line extension 70 of the wire 60. Thus, the operator can easily visually determine a positional relationship of the lock 13 and the receiving portion 23 and can easily control the position and movement of the lock 13 by gripping the wire 60. Thus, operability in positioning the mounting holes with respect to the female screw holes for locking is good. In addition, since the inserting direction of the lock 13 into the receiving portion 23 is substantially parallel to the axial direction of the wire 60, locking the lock 13 to the receiving portion 23 is performed more easily.

Further, the step 13B of the lock 13 and the stopper 24 of the receiving portion 23 come into contact with each other to prevent following rotation of the terminal main body portion 11 when the first bolt 51 is tightened. Since the lock 13 and the receiving portion 23 for positioning the mounting holes with respect to the female screw holes also function to prevent following rotation of the terminal main body 11, the structure is simplified as compared with the case where both functions are exhibited by separate dedicated parts.

The grounding member 20 is formed with the first and second female screw holes 41, 42, the terminal main body 11 is formed with the first mounting hole 151 corresponding to the first female screw hole 41 and the second mounting hole 152 corresponding to the second female screw hole 42, and the difference between the inner diameters of the second female screw hole 42 and the second mounting hole 152 is larger than the difference between the inner diameters of the first female screw hole 41 and the first mounting hole 151. The bolt first is tightened at the first female screw hole 41 and the first mounting hole 151 having a smaller inner diameter difference to fix the ground terminal fitting 10 to the grounding member 20. Thus, there is no likelihood that the opening area of the second mounting hole 152 deviates from that of the second female screw hole 42 at the second female screw hole 42 and the second mounting hole 152 having a larger inner diameter difference.

The distance from the receiving portion 23 to the first female screw hole 41 (i.e. distance from the lock 13 to the first mounting hole 151) exceeds the distance from the receiving portion 23 to the second female screw hole 42 (i.e. distance from the locking portion 13 to the second mounting hole 152). The technical significance of this configuration is as follows. In the case of tightening the bolt, a moment acting on the receiving portion 23 and the lock 13 is suppressed lower as a distance from a center of rotation of the bolt to the receiving portion 23 becomes longer. Thus, the distance from the first female screw hole 41 to be bolt-fastened first to the receiving portion 23 exceeds the distance from the second female screw hole 42 to be bolt-fastened later to the receiving portion 23. In this way, loads on the receiving portion 23 and the lock 13 can be reduced.

The receiving portion 23 on the grounding member 20 is in the form of a through hole and the lock 13 formed on the ground terminal fitting 10 is cantilevered and includes the step 13B. The lock 13 is locked to the receiving portion 23 in a state where the step 13B can come into contact with the stopper 24 of the receiving portion 23. In tightening the first bolt 51 at the first mounting hole 151 and the first female screw hole 41, a rotational force in a direction to bring the step 13B into contact with the stopper 24 is applied to the terminal main body 11. In this case, if the rotational force acting on the terminal main body portion 11 is strong, the step 13B may be separated from the stopper 24 while the terminal main body 11 rotates following the first bolt 51, and the lock 13 may improperly sink deep into the receiving portion 23. However, the terminal main body 11 of the invention is provided with the butting portions 14 for preventing the following rotation of the terminal main body portion 11. The butting portions 14 protrude from the side edges 13D of the locking portion 13 and contact the receiving surfaces 25, which are areas of the ground contact surface 21 near the opening edge of the receiving portion 23, when the first bolt 51 is tightened. In addition, since the pair of butting portions 14 are provided at the opposite sides of the lock 13, they stably contact with the receiving surfaces 25. This contact action prevents the lock 13 from improperly sinking into the receiving portion 23 and the following rotation of the terminal main body 11. In this way, a displacement of the second mounting hole 152 with respect to the second female screw hole 42 is also prevented.

The invention is not limited to the above described and illustrated embodiment. For example, the following embodiments are also included in the scope of the present invention.

Although the pair of butting portions are provided to protrude from the opposite side edges of the locking portion in the above embodiment, the butting portion may protrude only from either one of the side edges of the lock.

Although the inserting direction of the lock into the receiving portion is substantially parallel to the axial direction of the wire in the above embodiment, it may be a direction intersecting with the axial direction of the wire.

Although two mounting holes and two female screw holes are provided in the above embodiment, more or fewer mounting holes and female screw holes may be provided.

Although the female screw holes are formed on the nuts fixed to the under surface of the panel constituting the ground contact surface of the grounding member in the above embodiment, they may be directly formed on a base constituting the ground contact surface of the grounding member.

Although the first mounting hole, the second mounting hole and the lock (i.e. the first female screw hole, the second female screw hole and the receiving portion) constitute vertices of a triangle in the above embodiment, they may be side by side on one straight line.

Although the distance from the first mounting hole to be first bolt-fastened to the lock (i.e. distance from the first female screw hole to the receiving portion) is longer than that from the second mounting hole to be bolt-fastened later to the locking portion (i.e. distance from the second female screw hole to the receiving portion) in the above embodiment, the distance from the first mounting hole to the lock may be equal to or shorter than that from the second mounting hole to the lock.

Although the first mounting hole is arranged at the position deviated from the line connecting the lock and the wire connecting portion (axis line extension line of the wire) in the above embodiment, it may be arranged on the line connecting the lock and the wire connecting portion.

Although the second mounting hole is arranged at the position on the line connecting the lock and the wire connecting portion (axis line extension line of the wire) in the above embodiment, it may be arranged at a position deviated from the line connecting the lock and the wire connecting portion.

Although the difference between the inner diameters of the first female screw hole to be first bolt-fastened and the first mounting hole is set smaller than that between the inner diameters of the second female screw hole to be bolt-fastened later and the second mounting hole in the above embodiment, it may be equal to or larger than the difference between the inner diameters of the second female screw hole and the second mounting hole.

Although the inner diameter of the first mounting hole to be first bolt-fastened is set substantially equal to that of the first female screw hole in the above embodiment, the inner diameter (opening area) of the first mounting hole may be set larger than that (opening area) of the first female screw hole.

Although the inner diameter of the second mounting hole to be bolt-fastened later is set larger than that of the second female screw hole in the above embodiment, the inner diameter of the second mounting hole may be set substantially equal to that of the second female screw hole.

Although the inner diameters of the first and second female screw holes are set equal in the above embodiment, they may be different.

Although the inner diameter of the first mounting hole is set smaller than that of the second mounting hole in the above embodiment, it may be equal to or larger than the inner diameter of the second mounting hole.

LIST OF REFERENCE SIGNS

10 . . . ground terminal fitting
11 . . . terminal main body
12 . . . wire connecting portion
13 . . . lock
13B . . . step
13D . . . side edge
14 . . . butting portion
151 . . . first mounting hole
152 . . . second mounting hole
20 . . . grounding member
21 . . . ground contact surface
23 . . . receiving portion
24 . . . stopper
25 . . . receiving surface
41 . . . first female screw hole
42 . . . second female screw hole
51 . . . first bolt
52 . . . second bolt
60 . . . wire
70 . . . axis line extension line

What is claimed is:

1. A connection structure, comprising:

a grounding member including a ground contact surface;

a first female screw hole formed on the grounding member;

a second female screw hole formed on the grounding member;

a receiving hole formed on the grounding member;

a ground terminal fitting;

a plate-like terminal main body formed on the ground terminal fitting and capable of coming into surface contact with the ground contact surface;

a lock cantilevered from an outer periphery of the terminal main body, formed with a step configured to be locked with the step contact with an opening edge of the receiving hole by inserting a projecting end of the lock into the receiving;

a first mounting hole formed on the terminal main body and corresponding to the first female screw hole by locking the lock to the receiving hole; and a second mounting hole formed on the terminal main body and corresponding to the second female screw hole by locking the lock to the receiving; wherein:

the ground terminal fitting is mounted in surface contact with the grounding member by inserting a first bolt through the first mounting hole, screwing into the first bolt into the first female screw hole, inserting a second bolt through the second mounting hole and screwing the second bolt into the second female screw hole;

a rotational force in a direction to bring the step into contact with the opening edge of the receiving hole is applied to the terminal main body when the first bolt is tightened; and the terminal main body includes at least one butting portion protruding from a side edge of the lock extending along a projecting direction and configured to prevent following rotation of the terminal main body by contacting an area of the ground contact surface near an opening area of the receiving hole when the first bolt is tightened.

2. The connection structure of claim 1, wherein the terminal main body has two butting portions at opposite sides of the lock.

3. The connection structure of claim 1, wherein a difference between inner diameters of the second female screw hole and the second mounting hole is larger than a difference between inner diameters of the first female screw hole and the first mounting hole.

4. The connection structure of claim 1, wherein a distance from the receiving hole to the first female screw hole is set longer than a distance from the receiving hole to the second female screw hole.

5. The connection structure of claim 1, wherein:

the ground terminal fitting includes a wire connecting portion to which a wire is connected;

the lock is arranged on an axis line extension line of the wire connected to the wire connecting portion; and an inserting direction of the lock into the receiving hole is substantially parallel to an axial direction of the wire.

* * * * *